US006896598B2

(12) United States Patent
Saitoh

(10) Patent No.: US 6,896,598 B2
(45) Date of Patent: May 24, 2005

(54) VERTICAL TYPE OF DOUBLE DISC SURFACE GRINDING MACHINE

(75) Inventor: Akiyoshi Saitoh, Ikeda (JP)

(73) Assignee: Daisho Seiki Corporation, Ikeda (JP)

( * ) Notice: Subject to any disclaimer, the term of this patent is extended or adjusted under 35 U.S.C. 154(b) by 13 days.

(21) Appl. No.: 10/265,637

(22) Filed: Oct. 8, 2002

(65) Prior Publication Data

US 2004/0067722 A1 Apr. 8, 2004

(51) Int. Cl.[7] ..... B24B 1/00

(52) U.S. Cl. ..... 451/262; 451/41; 451/58; 451/65; 451/177; 451/190; 451/194; 451/261

(58) Field of Search ..... 451/41, 68, 65, 451/177, 190, 194, 261, 267, 259, 262, 268, 269

(56) References Cited

U.S. PATENT DOCUMENTS 5,942,445 A * 8/1999 Kato et al. ..... 438/691
6,217,423 B1 * 4/2001 Ohmori et al. ..... 451/63
6,485,357 B1 * 11/2002 Divine ..... 451/58

FOREIGN PATENT DOCUMENTS

JP 50-009193 1/1975
JP 05-131349 5/1993
JP 2001-009654 1/2001

* cited by examiner

*Primary Examiner*—Joseph J. Hail, III
*Assistant Examiner*—Shantese McDonald
(74) *Attorney, Agent, or Firm*—Crowell & Moring LLP

(57) ABSTRACT

In a vertical type of double disc surface grinding machine, an object of this invention is to enable simple adjustment of a parallelism between a grinding surface of a lower grinding wheel and a work end face clamped by a clamping jig of a rotary table, even when a grinding wheel spindle axis is disordered. The vertical type of double disc surface grinding machine is equipped with a pair of grinding wheels 2 & 3 opposing each other in vertical direction and fixed to a pair of vertical grinding wheels 4 & 5 and a rotary table 15 holding a work W and supplying it to a grinding position A1 located between the grinding wheels 2 & 3, and provided on the rotary table 15 with a work clamping jig 17 including a rotary shaft 63 which clamps the work W at a specified position and makes it spin itself. The table 15 and a bed 14 supporting its drive mechanism are supported by plural supporting legs 12 adjustable in their heights, so that front-to-back and right-to-left inclination angles can be adjusted in relation to horizontal level, and the supporting legs 12 are installed on a slide bed 11 slidable in horizontal direction.

2 Claims, 5 Drawing Sheets

VERTICAL TYPE OF DOUBLE DISC SURFACE GRINDING MACHINE

BACKGROUND OF THE INVENTION

1. Technical Field of the Invention

This invention relates to a vertical type of double disc surface grinding machine, in which a pair of grinding wheels opposing each other in vertical direction are installed, a work is securely clamped to a work clamping jig provided on a rotary table, the work is supplied to a grinding position located between the grinding wheels, and both upper and lower surfaces of the work are ground simultaneously while the work is rotated around a spindle axis of the work clamping jig.

2. Prior Art

Generally, the vertical type of double disc surface grinding machine is equipped with a work supplying device suitable for a supplied work according to its size and type. In a work which can not be held at its center and is small in its rigidity such as a piston ring etc., for example, a work supplying device is used wherein the work is held in a work holding hole formed on a thin-plate type rotary carrier in such a way that both upper and lower end faces of the work are protruding from the hole respectively, and the work is supplied to the grinding position between the grinding wheels while making the work spin itself by means of a ring gear mechanism etc. Further, even when the work has a high rigidity such as a connecting rod or its shape is complicated not like a rotation body, the work supplying device is used wherein the rotary carrier including the above-mentioned work holding hole is provided in order to hold the work in a freely rotatable manner.

On the other hand, for a work which is a rotation body as like an automobile disc brake and has a constant rigidity so as not to be deformed even when held at its central portion, a work supplying device is used wherein a central portion of the work is clamped to a clamping jig and the work is rotated together with the rotating spindle of the clamping jig so that the work is supplied to the grinding position between the grinding wheels.

In general, the both upper and lower grinding wheels of the vertical type of double disc surface grinding machine are so designed as to be movable in vertical direction. The upper grinding wheel is equipped with an adjusting mechanism for adjusting an inclination angle of its spindle axis, so that the wheel can be adjusted in its parallelism with respect to the lower grinding wheel. A spindle axis of the lower grinding wheel has been fixed to its vertical position when shipped.

PROBLEMS OF THE PRIOR ART TO BE RESOLVED

There may a case where a verticalness of the lower grinding wheel spindle axis is disordered due to a manufacturing error or shocks during transportation and manufacturing work, so as to produce a disorder of horizontalness of an upper grinding surface of the lower grinding wheel. Since the work is held in the work holding hole in the former work supplying device, there is an allowance for the work to incline according to the grinding surface of the grinding wheel in the holding hole, and thereby a work grinding thickness can be kept uniform.

Since the work is clamped to the rotating spindle of the clamping jig in the later work supplying device, there is no chance for the work to automatically incline according to the grinding surface, so that the work grinding thickness can not be kept uniform to cause a decrease in a grinding accuracy. In addition, the lower grinding shaft must be disassembled to adjust its verticalness by adjusting a bearing shim in order to correct the grinding accuracy. Therefore, the correction of accuracy will become very troublesome.

An object of the invention of this application is to provide a vertical type of double disc surface grinding machine which can simply improve the grinding accuracy without requiring the troublesome shim adjustment of the grinding spindle by enabling simple adjustment of horizontal position of the work according to an inclination of the lower grinding wheel, even when a horizontalness of the lower grinding wheel, i.e. a verticalness of the lower grinding wheel spindle, becomes out of order to some extent.

SUMMARY OF THE INVENTION

An invention of this application as set forth in claim 1, in a vertical type of double disc surface grinding machine which is equipped with a pair of grinding wheels opposing each other in vertical direction and fixed to a pair of vertical grinding wheels and a rotary table holding a work and supplying it to a grinding position located between the grinding wheels, and provided on the rotary table with a work clamping jig including a rotary shaft which clamps the work at a specified position and makes it spin itself; is characterized in that a bed supporting a table and its drive mechanism are supported by plural supporting legs adjustable in their heights, so that front-to-back and right-to-left inclination angles in relation to a horizontal level can be adjusted.

An invention of this application as set forth in claim 2, in the vertical type of double disc surface grinding machine as cited in claim 1; is characterized in that the supporting legs are provided for a slide bed which can be slidably adjusted in a horizontal direction.

DETAILED DESCRIPTION OF THE PREFERRED EMBODIMENTS

Figure 1:
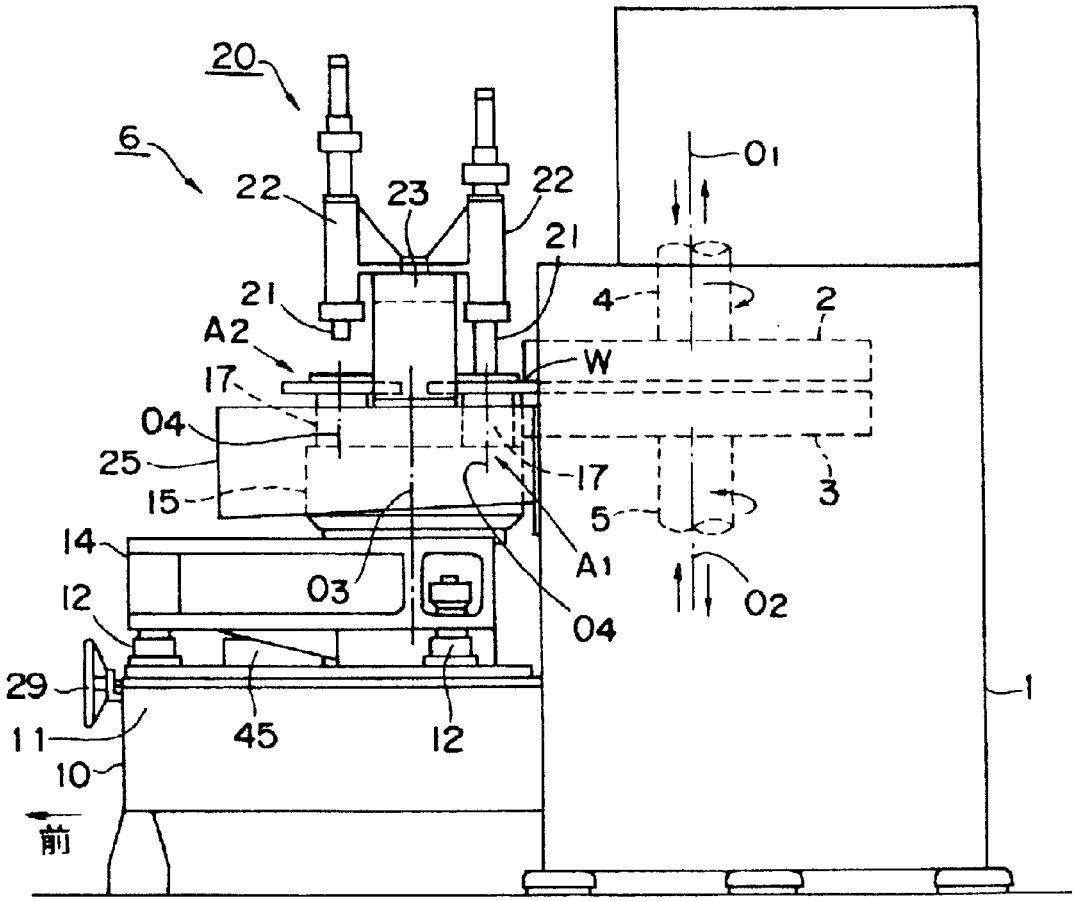
FIG. 1 is a side view of a vertical type of double disc surface grinding machine to which the invention of this application is applied.

FIG. 1 is the side view of the vertical type of double disc surface grinding machine to which the invention of this application is applied. A pair of grinding wheels 2 & 3 opposing each other in vertical direction and a not-shown power transmitting mechanism are housed in a body case 1, and a work supplying device 6 is installed adjacent to the body case 1. For convenience of explanation, description will be made on a condition that a side where the work supplying device 6 is installed is assumed as a front side.

A lower grinding wheel 3 is secured to the top end of a vertical lower grinding wheel spindle 5, an upper grinding wheel 2 is secured to the bottom end of an upper grinding wheel spindle 4 disposed on a spindle axis 01 concentric with a lower grinding wheel spindle axis 02. The both grinding wheel spindles 4 & 5 are so designed as movable in the vertical direction by elevating mechanisms respectively and are connected to the power transmitting mechanism so as to rotate in reverse directions each other.

The work supplying device 6 is composed of a base 10 supported by a floor surface and a front side of the body case 1, a slide bed 11 supported on the base 10 in such a way as slidable in front-to-back direction, three supporting legs 12 installed on the slide bed 11 and adjustable in their heights, a bed 14 supported by the supporting legs 12, a rotary table (index table) 15 supported by the bed 14 in a freely rotatable manner, a pair of work clamping jigs 17 installed on the rotary table 15, and a clamping device 20 which clamps a work W placed on the work clamping jig 17 from above.

The clamping device 20 is composed of a pair of cylinders 22 including clamping rods 21 extendable in lower direction, the respective cylinders 22 are disposed on axes concentric with the rotating spindle axes 04 of the work clamping jigs 17 and fixed to a gate-type bracket 23 secured onto an upper surface of the rotary table 15. When the clamping rod 21 is moved downward, the work W placed on the work clamping jig 17 is pushed down. Under the state where the work W is pushed down, the clamping rod 21 can be rotated together with the work W around the clamping jig spindle axis 04.

A protection cover 25 is disposed around the rotary table 15 and secured to the front side of the body case 1.

Figure 2:
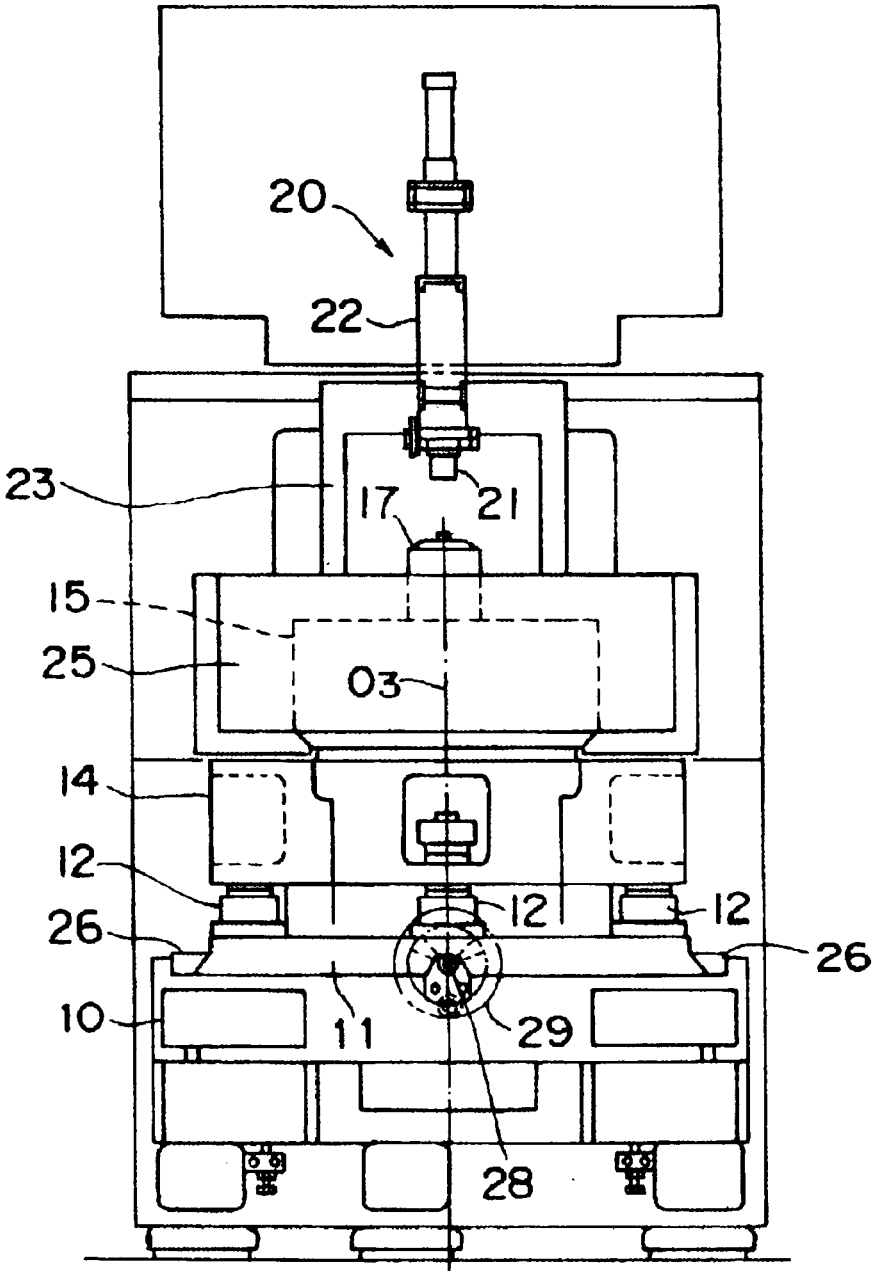
FIG. 2 is a front view of FIG. 1.

FIG. 2 is the front view (front-side view) of FIG. 1. A pair of guide rails 26 having trapezoidal sections are disposed on the base 10 at its right and left sides. Slant faces of the guide rails 26 contact with slant faces formed on right and left ends of the slide bed 11, so that the slide bed 11 is supported in such a way as slidable freely only in front-to-back direction. In addition, the slide bed 11 can be locked at any desired front-to-back position by a not-shown locking bolt mechanism.

Figure 3:
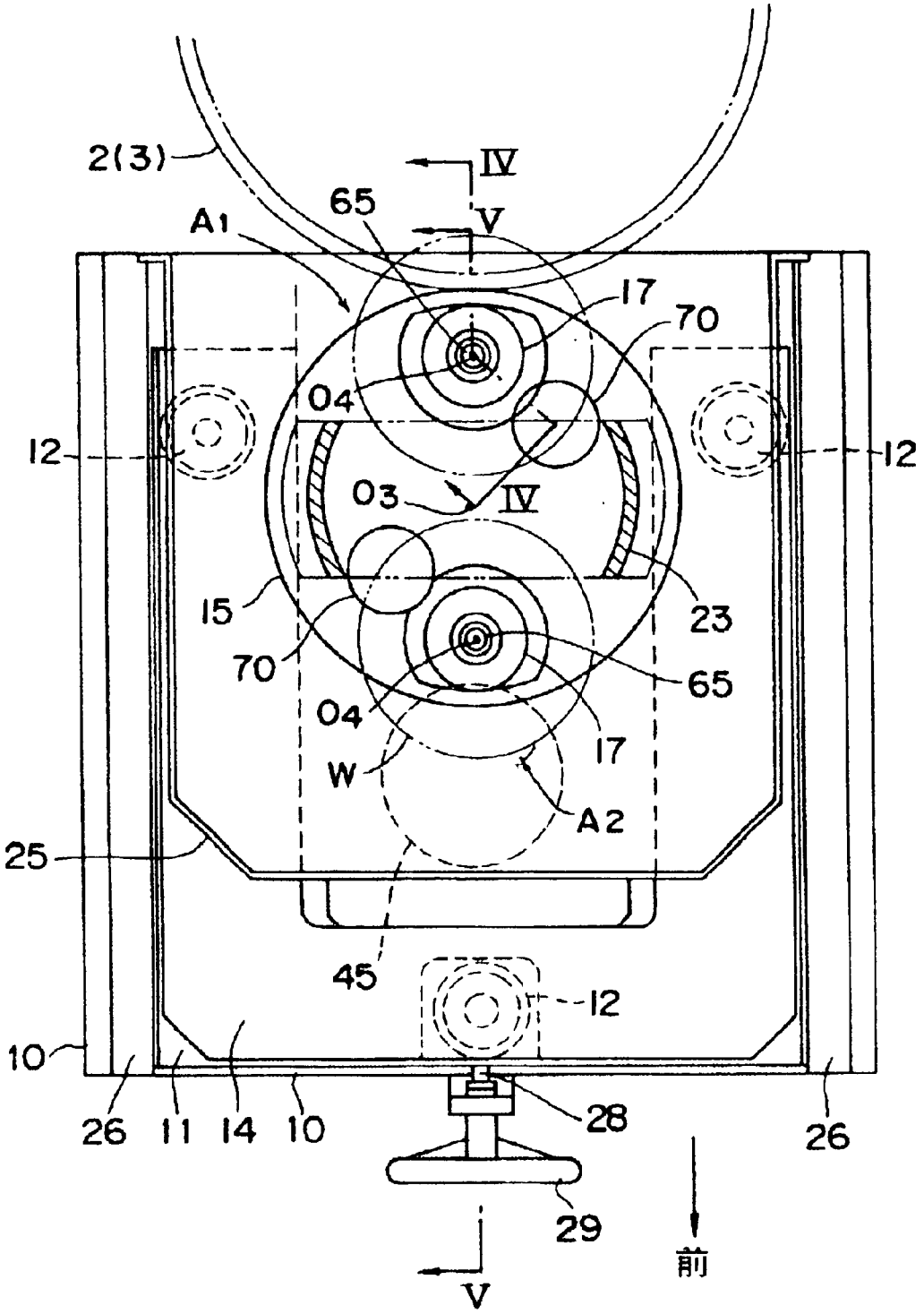
FIG. 3 is a plan view of FIG. 2.

FIG. 3 is the enlarged plan view of FIG. 2. A bed is formed into a rear-facing U-shape viewing from above, the three supporting legs 12 are disposed at a laterally central portion of the front end part of the bed 14, and at right and left end portions of the rear end part.

Figure 5:
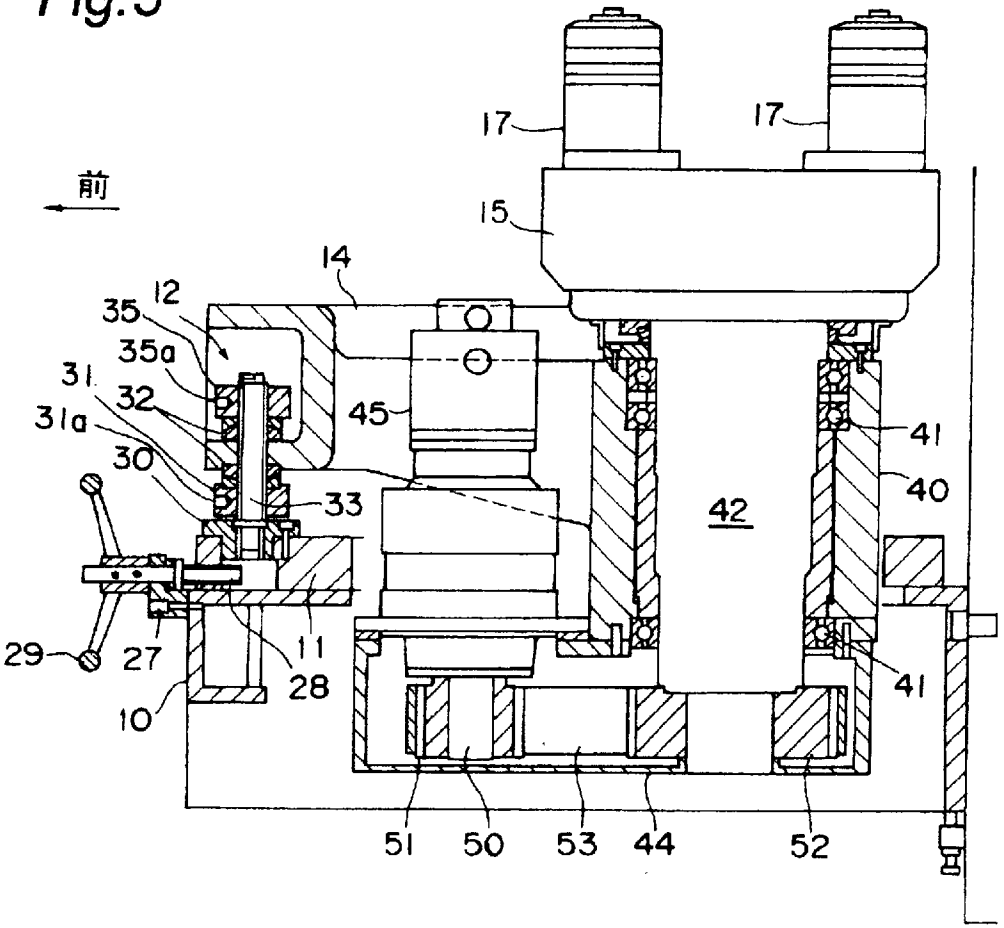
FIG. 5 is a sectional view taken on a line V—V of FIG. 3.

The both work clamping jigs 17 are disposed around a table spindle axis 03 with 180-degrees phase difference put between them, so that positional change can be done between a grinding position A1 at the grinding wheel side and a supplying and removing position A2 of the other side when the rotary table 15 is turned by half-turn FIG. 5 is the enlarged sectional view taken on the line V—V of FIG. 3. A portion of the bed 14 corresponding to the supporting leg 12 is formed into a hollow structure having an U-shape cross section. The supporting leg 12 is composed of a base nut 30 secured to the slide bed 11, a body bolt 33 secured to the base nut 30 in vertical position, an adjusting nut screwed into the body bolt 33, a spherical joint 32 contacting with the adjusting nut 31 from above and holding a lower wall portion of the bed 14 from both upper and lower sides, and a lock nut 35 screwed into an upper side of the spherical joint 32. In other words, the bed 14 can be adjusted in its supporting height through the spherical joint 32 when the adjusting nut 31 is turned and adjusted by loosening the lock nut 35, and the bed 14 can be adjusted in inclinations in front-to-back and right-to-left directions with respect to the horizontal level by adjusting the respective supporting heights of the supporting legs 12. Engaging holes 35*a* and 35*b* for inserting a turning tool are made on the lock nut 35 and the adjusting nut 31, respectively.

An L-shaped bracket 27 is secured to the front end face of the base 10, a screw shaft 28 for moving the slide bed 11 in the front-to-left direction is supported by the bracket in a rotatable but unmovable manner in an axial direction, the screw shaft 28 is screwed into a female screw hole made on a front wall of the slide bed 11, and an operation hand wheel 29 is fixed to the front end of the screw shaft 28. Namely, the slide bed 11 is so designed as to be movable in the front-to-back direction through screw feed function by turning the screw shaft 28 using the operation hand wheel 29.

A vertical boss portion 40 is integrally formed at the rear end of the bed 14, and a spindle portion 42 of the rotary table 15 is freely rotatably supported by the boss portion 40 through bearings 40. A transmission case 44 is fixed to the bottom end of the boss portion 40, and an electric motor 45 is fitted to a front upper face of the transmission case 44. In the transmission case 44, timing gears 51 & 52 are secured to bottom ends of a motor shaft 50 of the electric motor 45 and the spindle portion 42 of the rotary table 15 respectively, and a timing belt 53 is wound around the both timing gears 51 & 52.

Figure 4:
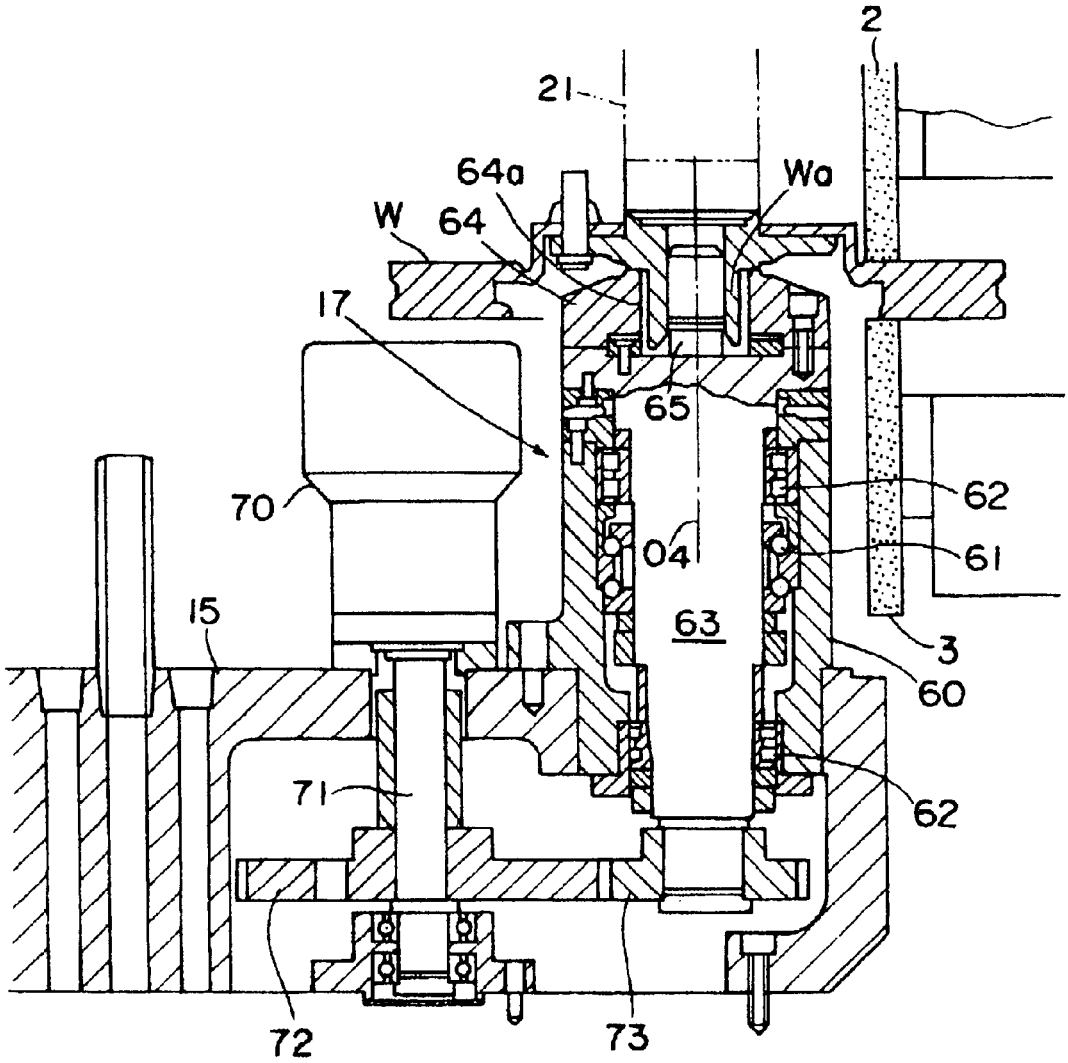
FIG. 4 is an enlarged sectional view take on a line IV—IV of FIG. 3.

FIG. 4 is the enlarged sectional view taken on the line IV—IV of FIG. 3. The work clamping jig 17 is provided with a cylindrical jig body 60 fixed to an upper wall of the rotary table 15 in the vertical position, and a rotating shaft 63 supported in a rotatable but unmovable manner in the axial direction in the jig body 60 through bearings 61 & 62. A positioning pin 65 protruding upward and located on a spindle axis concentric with the clamping jig spindle axis 04 is installed on an upper end face of the rotary shaft 63, and an annular work clamping bed 64 is fixed on it. The annular work clamping bed 64 has a center hole 64*a* into which a boss portion Wa of the work W can be inserted. A diameter of the positioning pin 65 is so determined that the work boss portion Wa can fit on it.

An electric motor 70 for turning the work is fitted on the rotary table 15 located toward a table center side from the work clamping jig 17, and a reduction gear 72 fixed to a motor shaft 71 of the electric motor 70 engages with a gear 73 fitted to the bottom end of the rotating shaft 63 within the rotary table 15. Namely, the rotating shaft 63 of the clamping jig 17 is rotated by rotation of the electric motor 70, and the work W clamped by the clamping rod 21 to the annular work clamping bed 64 can thereby be rotated (itself) around the clamping jig spindle axis 04.

[Function]

In FIG. 1, the respective work clamping jigs 17 are clamped in their positions between the rear-side grinding position A1 and the front-side supplying and removing position A2 through means of the half turning operation of the rotary table 15 as mentioned above. At the supplying and removing position A2, the already-ground work W is replaced by the not-yet-ground work W by moving the clamping rod 21 upward, and the not-yet-ground work W is clamped to the work clamping jig 17 by moving the clamping rod 21 downward. While, at the grinding position A1, the work W is turned around the clamping jig spindle axis 04 and the surface grinding is carried out simultaneously on the upper and lower end faces by the upper and lower grinding wheels 2 & 3.

When the work replacement is completed at the supplying and removing position A2 and the grinding of work is completed at the grinding position A1; the upper and lower grinding wheels 2 & 3 are separated apart from the upper and lower end faces of the work W located at the grinding position A1 respectively, the clamping jig 17 at the grinding position A1 is stopped its rotation, and the rotary table 15 is turned by 180 degrees.

The not-yet-ground work W moved from the supplying and removing position A2 to the grinding position A1 is rotated around the clamping jig spindle axis 04 integrally with the rotating shaft 63 and the clamping rod 21 through means of rotation of the rotating shaft 63 of the clamping jig 17 as shown by FIG. 4. The upper and lower grinding wheels 2 & 3 get near to this work W under the rotating state, so that the wheels will grind the upper and lower end faces of outer periphery of the work W to specified amounts, respectively.

[Inclination Adjustment]

In FIG. 1, the heights of the three supporting legs 12 supporting the bed 14 are adjusted individually. Thus, front-to-back and right-to-left inclinations of the bed 14 can be adjusted in relation to the horizontal level, thereby parallelism of the lower grinding wheel spindle axis 02 with the table spindle axis 03 and the clamping jig axis 04 can be adjusted, so that the upper and lower end faces of the work W can be set in parallel with the upper grinding surface of the lower grinding wheel 3.

In the above inclination adjustment, it is ideal that the lower grinding wheel spindle 5 is in the perpendicular position and the upper grinding surface of the lower grinding wheel 3 is in the horizontal position, then the position of the bed 14 is so adjusted that the table spindle axis 03 and the clamping jig spindle axis 04 will become perpendicular and the upper and lower end faces of the work will become horizontal. In actual case, however, the lower grinding wheel spindle axis 02 will be inclined against the perpendicular position within a range of allowable error or sometimes may be inclined by more than the allowable error due to vibrations during transportation or shocks produced during operation. In such a case, the table spindle axis 03 and the clamping jig spindle axis 04 are adjusted in parallel with the lower grinding wheel axis 02 and the upper and lower end faces of the work W are adjusted in parallel with the upper end grinding surface of the lower grinding wheel 3, not by adjusting the perpendicularity of the grinding wheel 5 but by adjusting an inclination angle of the bed 14. In case of the upper grinding wheel 4 too, an inclination angle of the upper grinding wheel 4 is adjusted to an inclination angle of the lower grinding wheel 5 so that the lower grinding surface of the upper grinding wheel will become in parallel with the upper grinding surface of the lower grinding wheel 3. Thereby, even if the perpendicularity of the lower grinding spindle axis 02 becomes disordered, the grinding work may be carried out under a state where the grinding wheels 2 & 3 and the work W are in parallel positions each other, and the grinding thickness of the work W is kept uniform to enable grinding operations on both surfaces with good accuracies.

[Front-to-back Adjustment]

In case where a grinding area becomes large or small by changing a kind of the work, the work W at the grinding position A1 can be moved to an optimum position with respect to the grinding wheels 2 & 3 by releasing the locked state of the bed 14 of FIG. 1 and by adjusting the location of the slide bed 11 in front-to-back direction through turning operation of the operation hand wheel 29.

ADVANTAGES OF THE INVENTION (1) In the vertical type of double disc surface grinding machine which is equipped with a pair of grinding wheels 2 & 3 opposing each other in vertical direction and fixed to a pair of vertical grinding spindles 4 & 5 and the rotary table 15 holding the work W and supplying it to the grinding position A1 located between the grinding wheels 2 & 3, and provided on the rotary table 15 with the work clamping jig 17 including the rotating shaft 63 which clamps the work W at the specified position and makes it spin itself; the bed 14 supporting the table 15 and its drive mechanism are supported by plural supporting legs 12 adjustable in their heights, so that the front-to-back and right-to-left inclination angles in relation to the horizontal level can be adjusted. For this reason, such a troublesome work as shim adjustment for the grinding wheel spindle axis 02 of the grinding wheel 3 becomes unnecessary even if the spindle axis 02 of the lower grinding wheel spindle 5 should be disordered from the vertical position. In addition, the upper and lower end faces of the work W can be set in parallel with the grinding wheels 2 & 3 by only carrying out the inclination adjustment of the bed 14 at the side of work supplying device, so that the grinding accuracy can be improved by the simple adjusting work. In other words, an uniformity of the work grinding thickness can be maintained.

(2) When the supporting legs 12 are installed on the slide bed 11 which is slidably adjustable in horizontal direction, the grinding area corresponding to respective works can be secured easily by only adjusting the slide bed 11 in front-to-back direction.

What is claimed is:

1. A vertical double disc surface grinding machine, comprising:

a pair of grinding wheels co-axially arranged on a vertical axis;

a rotary table for holding a work and supplying it to a grinding position located between the grinding wheels;

a working clamping jig provided on the rotary table, wherein the work clamping jig has a rotary shaft on which the work is held at a specified position and rotates the work; and a bed supporting the rotary table with a plurality of height-adjustable supporting legs which permit adjustment of rotary table front-to-back and right-to-left inclination angles in relation to a plane perpendicular to the vertical axis of the grinding wheels.

2. A vertical double disc surface grinding machine, comprising:

a pair of grinding wheels co-axially arranged on a vertical axis;

a rotary table for holding a work and supplying it to a grinding position located between the grinding wheels;

a working clamping jig provided on the rotary table, wherein the work clamping jig has a rotary shaft on which the work is held at a specified position and rotates the work; and a bed supporting the rotary table with a plurality of height-adjustable supporting legs which permit adjustment of rotary table front-to-back and right-to-left inclination angles in relation to a horizontal level, wherein the supporting legs are located on a slide bed that can be slidably adjusted in a horizontal direction.

* * * * *

US006896598C1

(12) EX PARTE REEXAMINATION CERTIFICATE (5546th)

United States Patent
Saitoh

(10) Number: US 6,896,598 C1
(45) Certificate Issued: Oct. 3, 2006

(54) VERTICAL TYPE OF DOUBLE DISC SURFACE GRINDING MACHINE

(75) Inventor: Akiyoshi Saitoh, Ikeda (JP)

(73) Assignee: Daisho Seiki Corporation, Ikeda (JP)

Reexamination Request:
No. 90/007,720, Sep. 15, 2005

Reexamination Certificate for:

| | |
|---|---|
| Patent No.: | **6,896,598** |
| Issued: | **May 24, 2005** |
| Appl. No.: | **10/265,637** |
| Filed: | **Oct. 8, 2002** |

(51) Int. Cl.
*B24B 1/00* (2006.01)

(52) U.S. Cl. ..... 451/262; 451/41; 451/58; 451/65; 451/177; 451/190; 451/194; 451/261; 451/267; 451/268; 451/269

(58) Field of Classification Search ..... 451/41, 451/58, 65, 177, 194, 261, 262
See application file for complete search history.

(56) References Cited

U.S. PATENT DOCUMENTS 3,872,626 A 3/1975 White
4,108,407 A 8/1978 Cable et al.
6,485,357 B1 11/2002 Divine

*Primary Examiner*—Jimmy G. Foster

(57) ABSTRACT

In a vertical type of double disc surface grinding machine, an object of this invention is to enable simple adjustment of a parallelism between a grinding surface of a lower grinding wheel and a work end face clamped by a clamping jig of a rotary table, even when a grinding wheel spindle axis is disordered. The vertical type of double disc surface grinding machine is equipped with a pair of grinding wheels 2 & 3 opposing each other in vertical direction and fixed to a pair of vertical grinding wheels 4 & 5 and a rotary table 15 holding a work W and supplying it to a grinding position A1 located between the grinding wheels 2 & 3, and provided on the rotary table 15 with a work clamping jig 17 including a rotary shaft 63 which clamps the work W at a specified position and makes it spin itself. The table 15 and a bed 14 supporting its drive mechanism are supported by plural supporting legs 12 adjustable in their heights, so that front-to-back and right-to-left inclination angles can be adjusted in relation to horizontal level, and the supporting legs 12 are installed on a slide bed 11 slidable in horizontal direction.

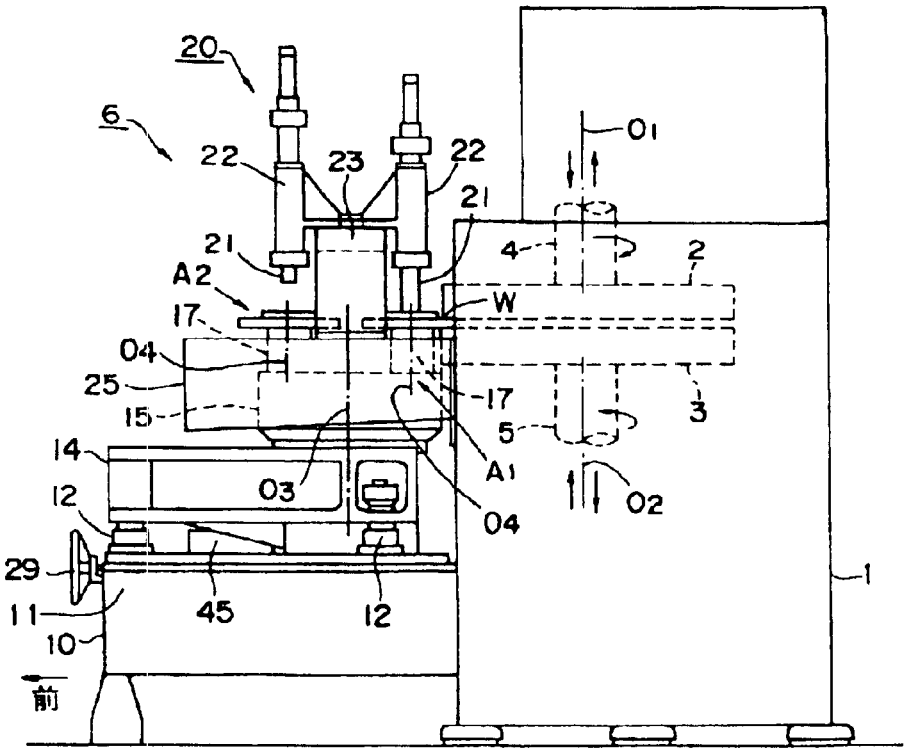

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1 and 2 is confirmed.

* * * * *